US008269130B2

(12) United States Patent
Mangan et al.

(10) Patent No.: US 8,269,130 B2
(45) Date of Patent: Sep. 18, 2012

(54) RETAINER, VACUUM INTERRUPTER, AND ELECTRICAL SWITCHING APPARATUS INCLUDING THE SAME

(75) Inventors: Dan J. Mangan, Painted Post, NY (US); Benjamin A. Rosenkrans, Painted Post, NY (US); Eric D. Smith, Painted Post, NY (US)

(73) Assignee: Eaton Corporation, Cleveland, OH (US)

( * ) Notice: Subject to any disclaimer, the term of this patent is extended or adjusted under 35 U.S.C. 154(b) by 408 days.

(21) Appl. No.: 12/711,545

(22) Filed: Feb. 24, 2010

(65) Prior Publication Data

US 2011/0204030 A1 Aug. 25, 2011

(51) Int. Cl.
*H01H 33/666* (2006.01)

(52) U.S. Cl. ..... 218/139; 218/120; 218/140

(58) Field of Classification Search ..... 218/7, 14, 218/120, 134–137, 143, 154
See application file for complete search history.

(56) References Cited

U.S. PATENT DOCUMENTS 2,867,705 A * 1/1959 Beckwith ..... 338/171
5,444,201 A 8/1995 Schulman et al.
5,597,992 A 1/1997 Walker
5,753,876 A 5/1998 Lanning
5,929,411 A 7/1999 Schulman
6,043,446 A 3/2000 Mayo et al.
6,417,473 B1 7/2002 Mayo et al.
2003/0085200 A1 5/2003 Rosenkrans et al.
2004/0144756 A1 7/2004 Rhein et al.

* cited by examiner

*Primary Examiner* — Amy Cohen Johnson
*Assistant Examiner* — Marina Fishman
(74) *Attorney, Agent, or Firm* — Eckert Seamans Cherin & Mellott, LLC; Kirk D. Houser

(57) ABSTRACT

A vacuum interrupter includes a number of insulative tubes having a first open end and a second open end; a first end member secured to the first open end; a second end member secured to the second open end; a fixed contact mounted on a fixed electrode extending through the second end member; a retainer; and a movable contact. The retainer includes a rigid retainer having a plurality of legs and an opening, and an insulative bushing having a smaller opening. The insulative bushing is molded over a portion of the rigid retainer. The smaller opening is within the opening of the rigid retainer and is structured to receive a movable electrode. The movable contact is mounted on the movable electrode extending through the first end member and through the smaller opening. The movable contact is capable of axially reciprocating into and out of contact with the fixed contact.

22 Claims, 6 Drawing Sheets

RETAINER, VACUUM INTERRUPTER, AND ELECTRICAL SWITCHING APPARATUS INCLUDING THE SAME

BACKGROUND

1. Field

The disclosed concept pertains generally to vacuum interrupters for protecting electric power circuits and, more particularly, to vacuum interrupters or vacuum envelopes including a movable electrode. The disclosed concept also pertains to retainers for the movable electrode of a vacuum interrupter. The disclosed concept further pertains to electrical switching apparatus, such as vacuum circuit interrupters, including a number of vacuum interrupters.

2. Background Information

Vacuum interrupters include separable main contacts disposed within an insulated and hermetically sealed vacuum chamber. The vacuum chamber typically includes a number of sections of ceramics (e.g., a number of tubular ceramic portions) for electrical insulation capped by a number of end members (e.g., without limitation, metal components, such as metal end plates; end caps; seal cups) to form an envelope in which a vacuum may be drawn. The ceramic section is typically cylindrical; however, other suitable cross-sectional shapes may be used. Two end members are typically employed. Where there are multiple ceramic sections, an internal center shield is disposed between the ceramic sections.

Vacuum circuit interrupters (e.g., without limitation, vacuum circuit breakers; vacuum switches; load break switches) provide protection for electrical systems from electrical fault conditions such as current overloads, short circuits, and low level voltage conditions. Typically, vacuum circuit interrupters include a spring-powered or other suitable operating mechanism, which opens electrical contacts inside a number of vacuum interrupters to interrupt the current flowing through the conductors in an electrical system in response to abnormal conditions.

The main contacts of vacuum interrupters are electrically connected to an external circuit to be protected by the vacuum circuit interrupter by electrode stems, typically an elongated member made from high purity copper. Generally, one of the contacts is fixed relative to the vacuum chamber as well as to the external circuit. The fixed contact is mounted in the vacuum envelope on a first electrode extending through one end member. The other contact is movable relative to the vacuum envelope. The movable contact is mounted on a movable electrode axially slidable through the other end member. The movable contact is driven by the operating mechanism and the motion of the operating mechanism is transferred inside the vacuum envelope by a coupling that includes a sealed metallic bellows. The fixed and movable contacts form a pair of separable contacts which are opened and closed by movement of the movable electrode in response to the operating mechanism located outside of the vacuum envelope. The electrodes, end members, bellows, ceramic shell(s), and the internal shield, if any, are joined together to form the vacuum interrupter capable of maintaining a vacuum at a suitable level for an extended period of time.

Known technology for a bushing for the movable electrode of a vacuum interrupter employs a plastic bushing in contact with the movable electrode and a metal retainer which holds the bushing in place. For example, the plastic bushing and the metal retainer include mating octagonal features, the plastic bushing and the movable electrode are disposed at and protrude from the bottom (or top) of the vacuum interrupter, and the metal retainer is disposed at the bottom (or top) of the plastic bushing. A portion of the metal retainer is spot welded to one vacuum interrupter end member or seal cup.

Some vacuum interrupters employ mounting studs near the movable electrode at the bottom (or top) of the vacuum interrupter for mounting to a vacuum circuit interrupter structure. The limited space between the movable electrode and the mounting studs prevents the use of the plastic bushing and the metal retainer, since the plastic bushing needs some mating feature in order that the metal retainer can rigidly hold the plastic bushing.

There is room for improvement in vacuum envelopes and vacuum interrupters employing a retainer and a bushing for a movable electrode.

There is also room for improvement in vacuum circuit interrupters, which employ a vacuum interrupter including a retainer and a bushing for a movable electrode.

There is further room for improvement in retainers and bushings for a movable electrode of a vacuum interrupter.

SUMMARY

These needs and others are met by embodiments of the disclosed concept, which provide a rigid retainer including a plurality of legs and an opening, and an insulative bushing including an opening. The insulative bushing opening is smaller than the rigid retainer opening. The insulative bushing is molded over a portion of the rigid retainer. The insulative bushing opening is within the rigid retainer opening and is structured to receive a movable electrode.

In accordance with one aspect of the disclosed concept, a vacuum interrupter comprises: a number of insulative tubes including a first open end and a second open end; a first end member secured to the first open end of the number of insulative tubes; a second end member secured to the second open end of the number of insulative tubes; a fixed contact mounted on a fixed electrode extending through the second end member; a retainer comprising: a rigid retainer including a plurality of legs and an opening, and an insulative bushing including an opening, wherein the opening of the insulative bushing is smaller than the opening of the rigid retainer, wherein the insulative bushing is molded over a portion of the rigid retainer, wherein the opening of the insulative bushing is within the opening of the rigid retainer, and wherein the opening of the insulative bushing is structured to receive a movable electrode; and a movable contact mounted on the movable electrode extending through the first end member and extending through the opening of the insulative bushing, the movable contact being capable of axially reciprocating into and out of contact with the fixed contact.

The insulative bushing may further include a conduit portion defining the opening of the insulative bushing. The conduit portion may include a first end having a first diameter and an opposite second end having a second diameter, which is larger than the first diameter. The plurality of legs of the rigid retainer may extend away from the opposite second end and may extend away from the conduit portion of the insulative bushing.

Each of the plurality of legs of the rigid retainer may include a first portion extending away from the opposite second end and extending away from the conduit portion of the insulative bushing, a second portion extending away from the first portion and extending toward the first end, and a third portion extending away from the second portion and extending away from the conduit portion of the insulative bushing.

The third portion may be disposed between the first end and the opposite second end; the third portion of each of the plurality of legs may be secured to the first end member; the first end of the conduit portion may extend into the first end member; and the opposite second end of the conduit portion may extend away from the first end member.

The first end member may include a plurality of mounting members extending away from the first end member and extending away from the first open end of the number of insulative tubes; the movable electrode may be disposed between the plurality of mounting members; and each of the plurality of legs may extend between an adjacent pair of the plurality of mounting members.

As another aspect of the disclosed concept, a retainer is for a movable electrode. The retainer comprises: a rigid retainer including a plurality of legs and an opening; and an insulative bushing including an opening, wherein the opening of the insulative bushing is smaller than the opening of the rigid retainer, wherein the insulative bushing is molded over a portion of the rigid retainer, wherein the opening of the insulative bushing is within the opening of the rigid retainer, and wherein the opening of the insulative bushing is structured to receive the movable electrode.

As another aspect of the disclosed concept, an electrical switching apparatus comprises: a vacuum interrupter comprising: a number of insulative tubes including a first open end and a second open end, a first end member secured to the first open end of the number of insulative tubes, a second end member secured to the second open end of the number of insulative tubes, a fixed contact mounted on a fixed electrode extending through the second end member, a retainer comprising: a rigid retainer including a plurality of legs and an opening, and an insulative bushing including an opening, wherein the opening of the insulative bushing is smaller than the opening of the rigid retainer, wherein the insulative bushing is molded over the rigid retainer, wherein the opening of the insulative bushing is within the opening of the rigid retainer, and wherein the opening of the insulative bushing is structured to receive a movable electrode, and a movable contact mounted on the movable electrode extending through the first end member and extending through the opening of the insulative bushing, the movable contact being capable of axially reciprocating into and out of contact with the fixed contact; and an operating mechanism structured to axially reciprocate the movable electrode and move the movable contact into and out of contact with the fixed contact.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

The disclosed concept is described in association with a vacuum circuit interrupter, although the disclosed concept is applicable to a wide range of electrical switching apparatus having any number of poles.

Figure 5:
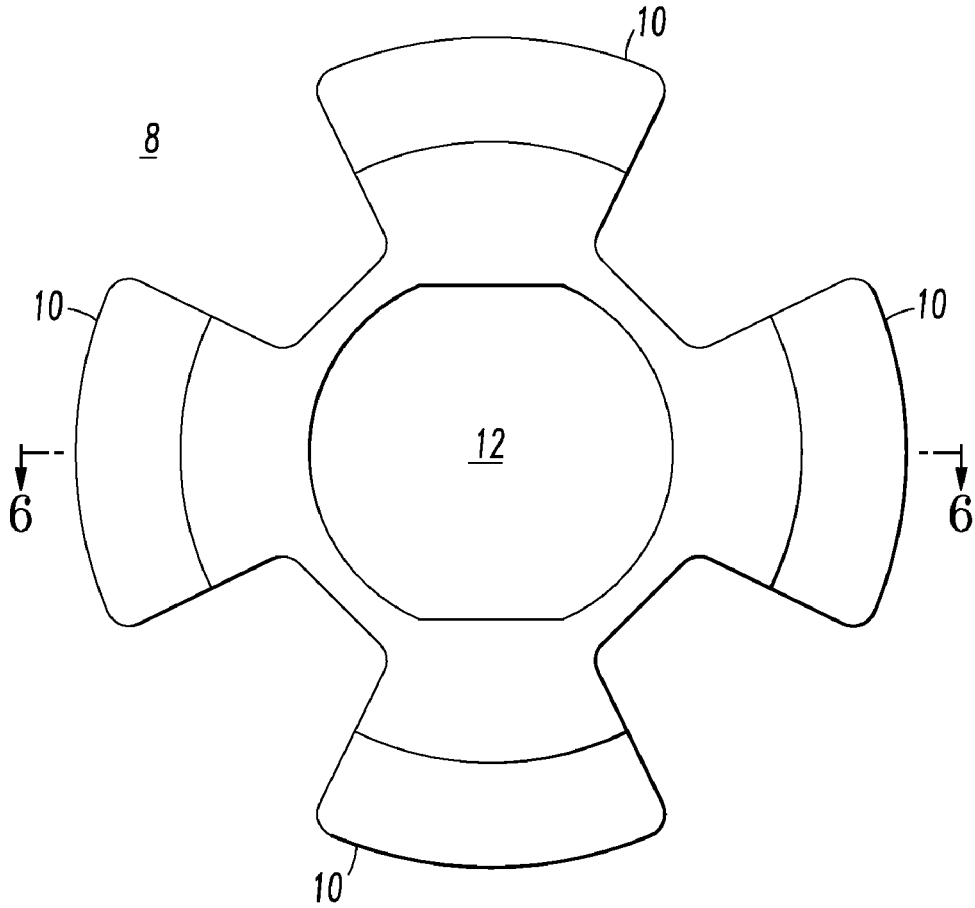
FIG. 5 is a top plan view of the metal retainer of FIG. 1.
Figure 6:
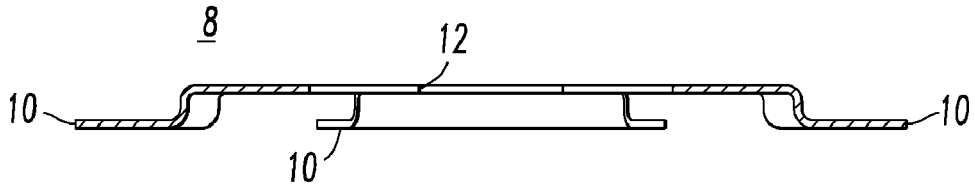
FIG. 6 is a cross-sectional view of the metal retainer along lines 6-6 of FIG. 5.
Figure 7:
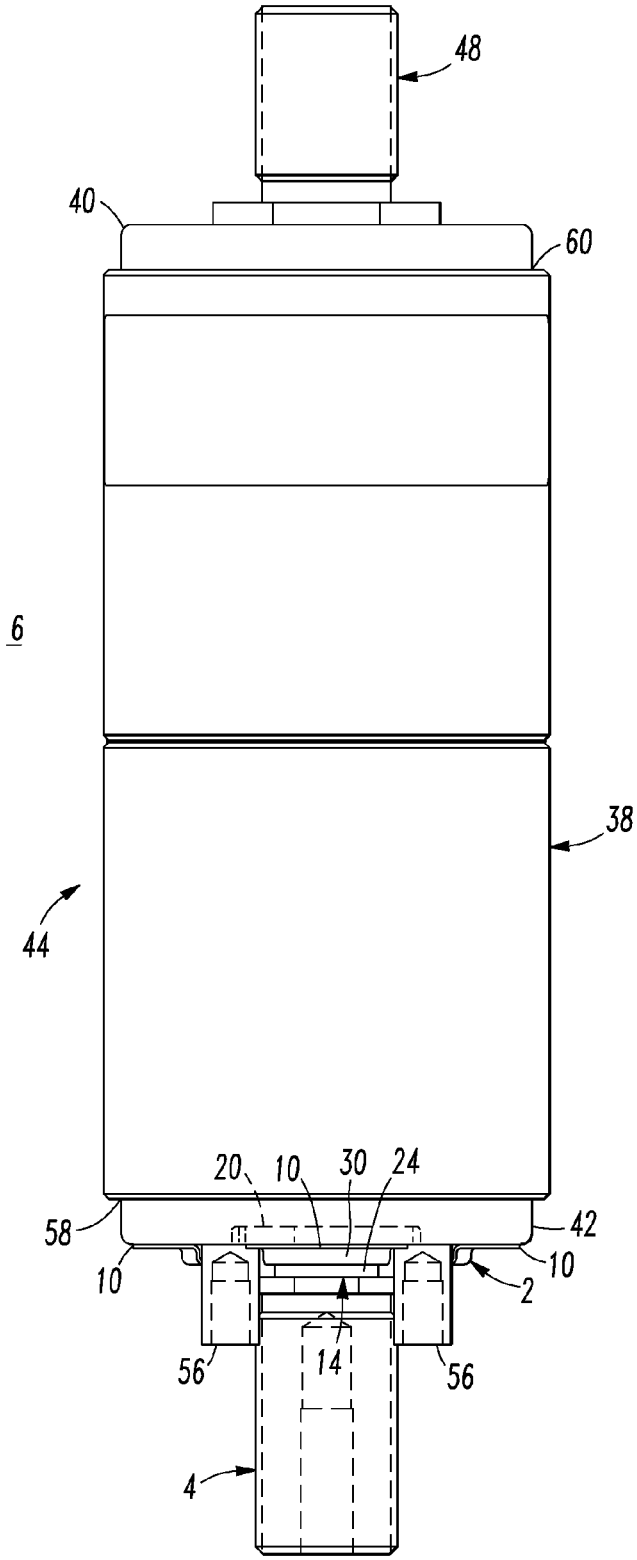
FIG. 7 is a vertical elevation view of a vacuum interrupter in accordance with embodiments of the disclosed concept.

Referring to FIGS. 1-4, a retainer 2 for a movable electrode 4 (FIG. 7) of a vacuum interrupter 6 (FIG. 7) is shown. The retainer 2 includes a rigid retainer 8 (best shown in FIGS. 5 and 6) including a plurality of legs 10 and an opening 12, and an insulative bushing 14 including an opening 16. The opening 16 of the insulative bushing 14 is smaller than the opening 12 of the rigid retainer 8. The insulative bushing 14 is molded over a portion of the rigid retainer 8. The smaller opening 16 of the insulative bushing 14 is within the larger opening 12 of the rigid retainer 8. The opening 16 of the insulative bushing 14 is structured to receive the movable electrode 4 (FIG. 7).

For example and without limitation, the rigid retainer 8 can be made of metal, such as, for example and without limitation, stainless steel. For example and without limitation, the insulative bushing 14 can be made of a suitable thermoplastic resin, such as Nylatron® GS-HS 44769AA. The example over molded retainer 2 includes the example stainless steel retainer 8 imbedded in the thermoplastic resin bushing 14, which is molded over a portion of the stainless steel retainer 8.

The example insulative bushing 14 includes a conduit portion 18 defining the insulative bushing opening 16. The conduit portion 18 includes a first end 20 having a first diameter 22 and an opposite second end 24 having a second diameter 26, which is larger than the first diameter 22. The rigid retainer legs 10 (e.g., without limitation, four legs 10 are shown) extend away from the opposite second end 24 and extend away from the insulative bushing conduit portion 18.

Figure 1:
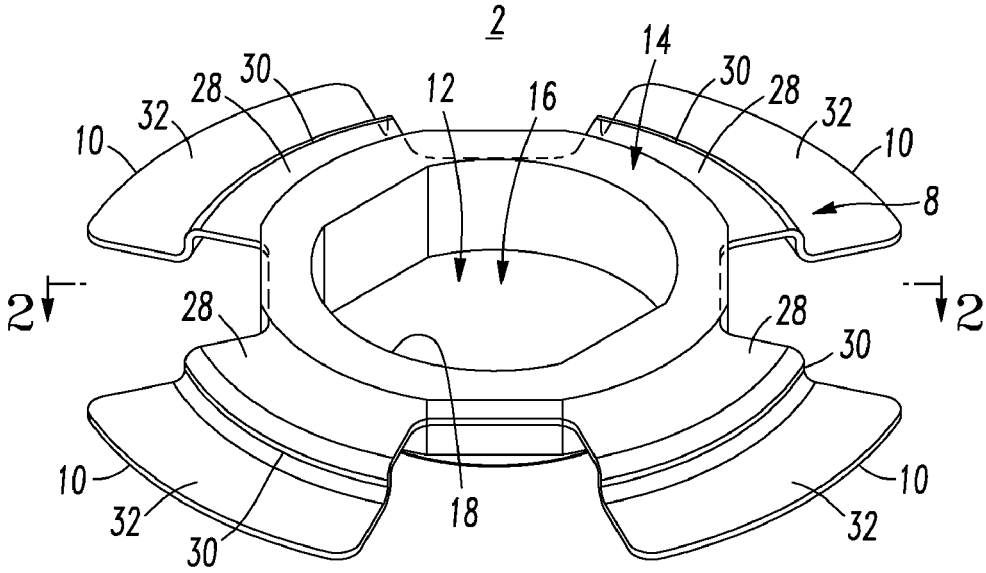
FIG. 1 is an isometric view of a retainer for a vacuum interrupter in accordance with embodiments of the disclosed concept.
Figure 2:
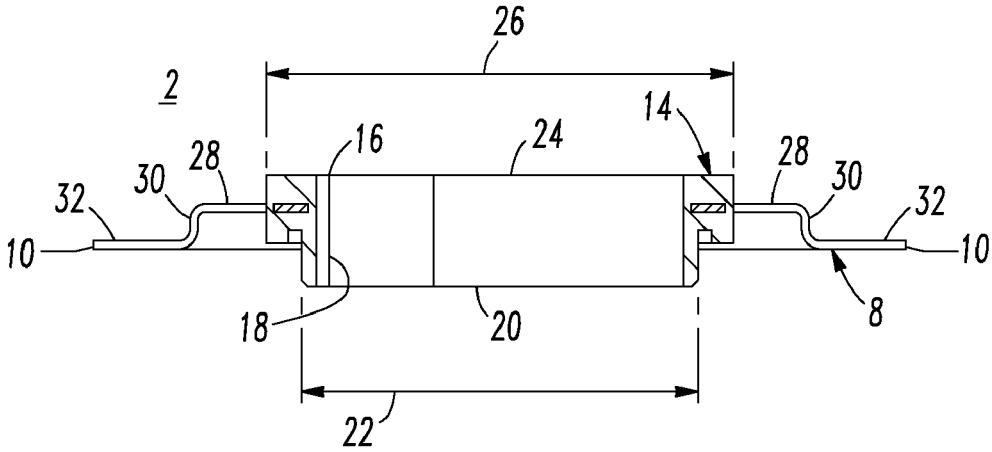
FIG. 2 is a cross-sectional view of the over molded retainer along lines 2-2 of FIG. 1.

As best shown in FIG. 2, each of the rigid retainer legs 10 includes a first portion 28 extending away from the opposite second end 24 and extending away from the conduit portion 18, a second portion 30 extending away from the first portion 28 and extending toward the first end 20, and a third portion 32 extending away from the second portion 30 and extending away from the conduit portion 18. The third portion 32 is disposed between the first end 20 and the opposite second end 24.

Figure 3:
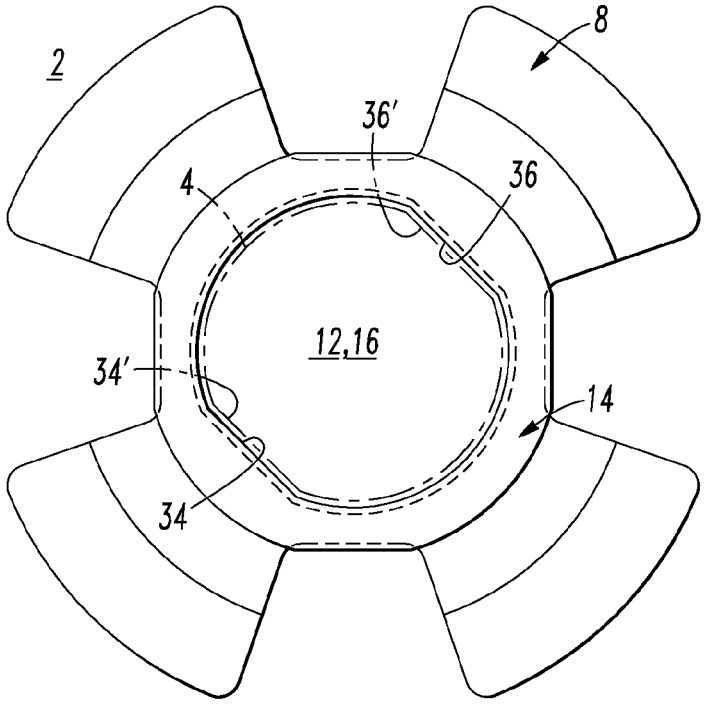
FIG. 3 is a top plan view of the over molded retainer of FIG. 1.
Figure 4:
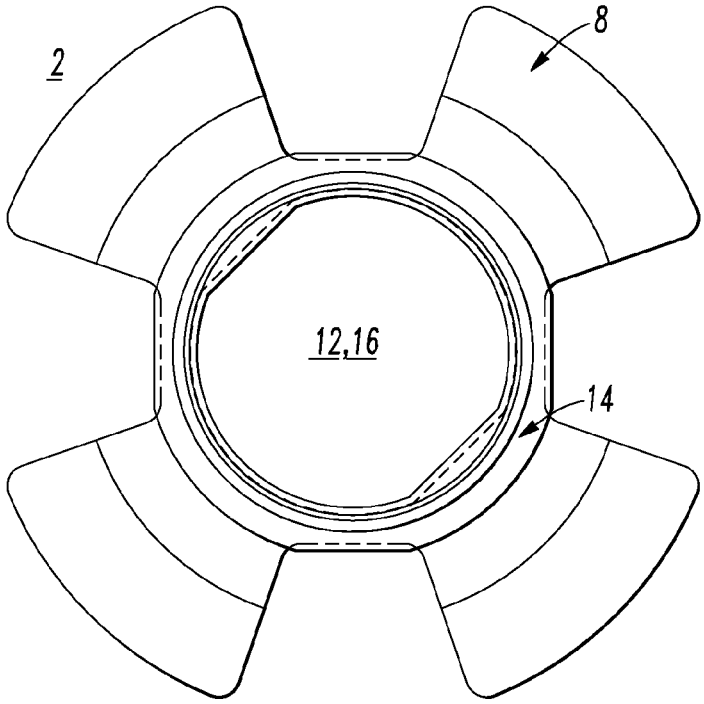
FIG. 4 is a bottom plan view of the over molded retainer of FIG. 1.

As best shown in FIG. 3, the opening 16 of the insulative bushing 14 includes a generally circular cross-section having a number of flat surfaces (e.g., without limitation, two flat surfaces 34,36 are shown), which prevent a twisting movement of the movable electrode 4 (shown in phantom line drawing). The movable electrode 4 includes the same generally circular cross-section of the insulative bushing 14 having the same number of flat surfaces 34N,36N. It will be appreciated that the insulative bushing 14 and the movable electrode 4 cooperate to maintain a vacuum in vacuum envelope 44 of FIG. 7.

Alternatively, the insulative bushing 14 can employ a keyway (not shown) or any other suitable structure other than the disclosed flat surfaces 34,36 as a mechanism to preventing the movable electrode 4 from twisting.

The disclosed insulative bushing 14 functions to guide the movable electrode 4 during operation while providing a number of features, such as the disclosed flat surfaces 34,36, to prevent the movable electrode 4 from twisting.

Figure 8:
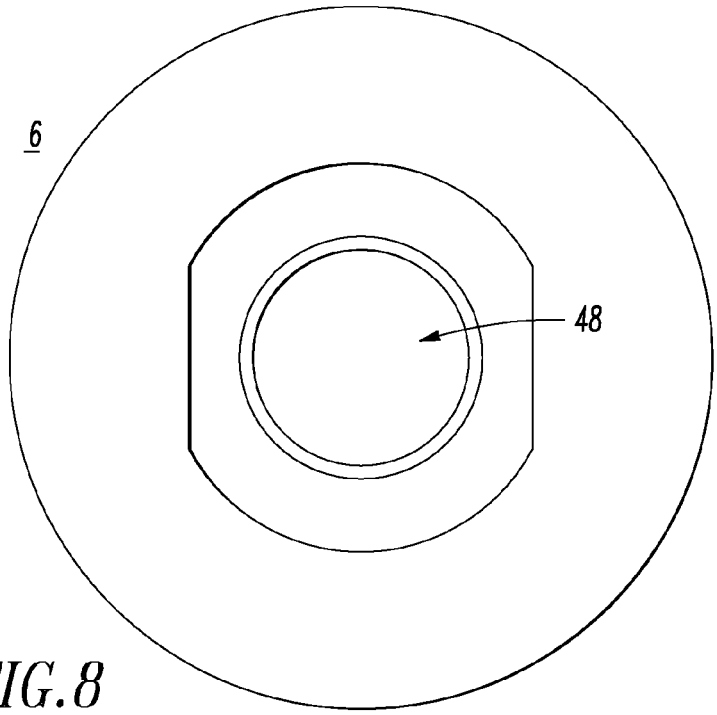
FIG. 8 is a top plan view of the vacuum interrupter of FIG. 7.
Figure 9:
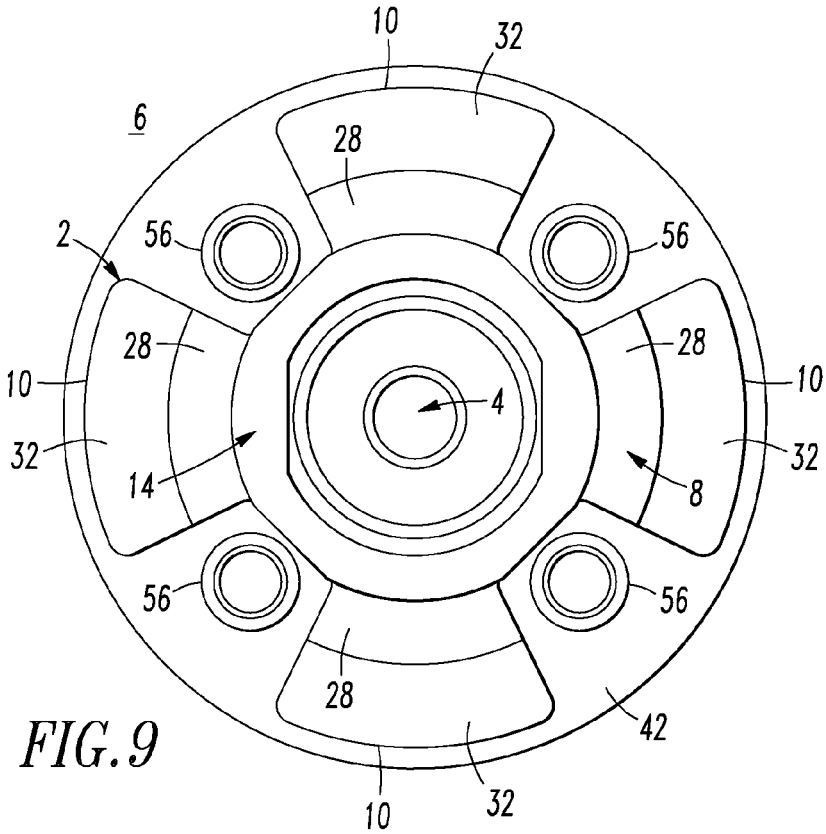
FIG. 9 is a bottom plan view of the vacuum interrupter of FIG. 7.

Referring to FIGS. 7-9, the vacuum interrupter 6 includes an insulative tube, such as the example number of ceramic tubes 38, which with end members 40 and 42 (e.g., without limitation, seal cups) form the vacuum envelope 44. A fixed contact 46 (shown in hidden line drawing in FIG. 10) is mounted on a fixed electrode 48, which extends through the end member 40. A movable contact 50 (shown in hidden line drawing in FIG. 10) is carried by the movable electrode 4 and extends through the other end member 42. The fixed contact 46 and movable contact 50 form separable contacts 52 (shown in hidden line drawing in FIG. 10), which when closed, complete an electrical circuit between the fixed electrode 48 and the movable electrode 4, and when opened by axial movement of the movable electrode 4 interrupt current flowing through the vacuum interrupter 6. The movable electrode 4 is moved axially to open and close the separable contacts 52 by an operating mechanism 54 (FIG. 10) connected to the movable electrode 4 outside of the vacuum envelope 44.

Although a two-piece ceramic tube 38 (e.g., without limitation, an upper ceramic and a lower ceramic, with a center shield flange sandwiched therebetween) is shown, the disclosed concept is applicable to vacuum interrupters including a number of ceramic or glass tubes.

As best shown in FIG. 9, the third portion 32 of each of the rigid retainer legs 10 of the retainer 2 is suitably secured (e.g., without limitation, spot welded) to the end member 42. That end member 42 includes a plurality (e.g., without limitation, four example mounting members 56 are shown) of mounting members 56 (e.g., without limitation, studs) extending away from the end member 42 and extending away from the open end 58 (FIG. 7) of the ceramic tube 38 (FIG. 7). The movable electrode 4 is disposed between the mounting members 56. Each of the legs 10 extends between an adjacent pair of the mounting members 56.

As shown in hidden line drawing in FIG. 7, the first end 20 of the conduit portion 18 (FIG. 2) of the insulative bushing 14 extends into the end member 42. The opposite second end 24 of the conduit portion 18 extends away from the end member 42.

The ceramic tube 38 of the vacuum interrupter 6 includes the first open end 58 and the opposite second open end 60. The first end member 42 is secured to the first open end 58, and the second end member 40 is secured to the opposite second open end 60 of the ceramic tube 38.

Figure 10:
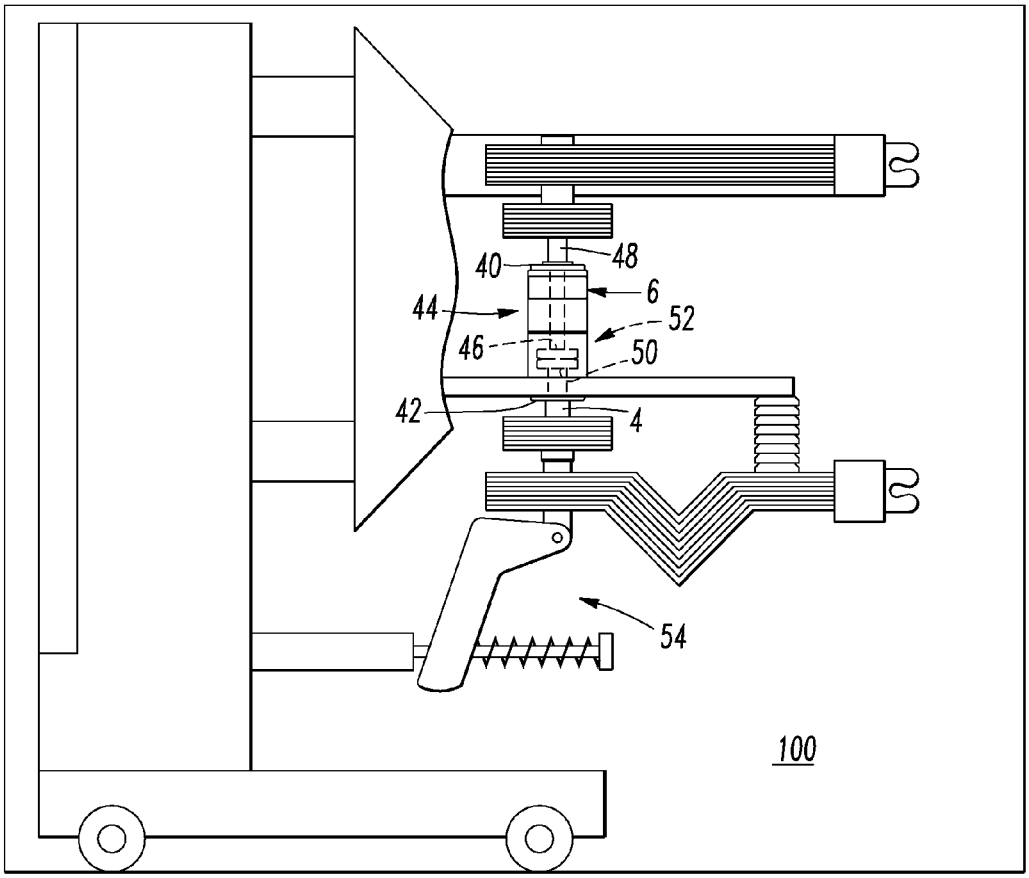
FIG. 10 is a simplified vertical elevation view of a vacuum circuit interrupter including the vacuum interrupter of FIG. 7.

As best shown in FIG. 10, the fixed contact 46 (shown hidden line drawing) is mounted on the fixed electrode 48 and extends through the second end member 40. The movable contact 50 (shown hidden line drawing) is capable of axially reciprocating into and out of contact with the fixed contact 46.

FIG. 10 shows an electrical switching apparatus, such as an example vacuum circuit interrupter 100, including the vacuum interrupter 6 of FIG. 7. The vacuum circuit interrupter 100 includes the operating mechanism 54 structured to axially reciprocate the movable electrode 4 and move the movable contact 50 into and out of contact with the fixed contact 46. The vacuum interrupter 6 is assembled into the example vacuum circuit interrupter 100 with the movable electrode 4 facing down (with respect to FIG. 10). Alternatively, the disclosed concept is applicable to configurations in which the movable electrode 4 faces in any suitable direction (e.g., without limitation, up (with respect to FIG. 10)).

The disclosed retainer 2 provides a relatively stronger bushing/retainer. The rigid retainer 8 inside the insulative bushing 14 reinforces the insulative bushing 14. This provides a more efficient use of space as compared to known prior vacuum interrupter bushings. This also provides for ease of assembly of the example vacuum interrupter 6.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A vacuum interrupter comprising:

a number of insulative tubes including a first open end and a second open end;

a first end member secured to the first open end of said number of insulative tubes;

a second end member secured to the second open end of said number of insulative tubes;

a fixed contact mounted on a fixed electrode extending through said second end member;

a retainer comprising:

a rigid retainer including a plurality of legs and an opening, and an insulative bushing including an opening, wherein the opening of the insulative bushing is smaller than the opening of the rigid retainer, wherein a portion of the rigid retainer is imbedded in the insulative bushing, wherein the insulative bushing is molded over the portion of the rigid retainer, wherein the opening of the insulative bushing is within the opening of the rigid retainer, and wherein the opening of the insulative bushing is structured to receive a movable electrode; and a movable contact mounted on the movable electrode extending through said first end member and extending through the opening of the insulative bushing, said movable contact being capable of axially reciprocating into and out of contact with said fixed contact, wherein said number of insulative tubes, said first end member, said second end member, the fixed electrode, the insulative bushing and the movable electrode form a vacuum envelope.

2. The vacuum interrupter of claim 1 wherein the rigid retainer is made of metal.

3. The vacuum interrupter of claim 1 wherein the rigid retainer is made of stainless steel.

4. The vacuum interrupter of claim 1 wherein the insulative bushing is made of a thermoplastic resin.

5. The vacuum interrupter of claim 1 wherein the insulative bushing further includes a conduit portion defining the opening of the insulative bushing.

6. The vacuum interrupter of claim 5 wherein the conduit portion includes a first end having a first diameter and an opposite second end having a second diameter, which is larger than the first diameter.

7. The vacuum interrupter of claim 6 wherein the plurality of legs of the rigid retainer extend away from the opposite second end and extend away from the conduit portion of the insulative bushing.

8. A vacuum interrupter comprising:

a number of insulative tubes including a first open end and a second open end;

a first end member secured to the first open end of said number of insulative tubes;

a second end member secured to the second open end of said number of insulative tubes;

a fixed contact mounted on a fixed electrode extending through said second end member;

a retainer comprising:

a rigid retainer including a plurality of legs and an opening, and an insulative bushing including an opening, wherein the opening of the insulative bushing is smaller than the opening of the rigid retainer, wherein the insulative bushing is molded over a portion of the rigid retainer, wherein the opening of the insulative bushing is within the opening of the rigid retainer, and wherein the opening of the insulative bushing is structured to receive a movable electrode; and a movable contact mounted on the movable electrode extending through said first end member and extending through the opening of the insulative bushing, said movable contact being capable of axially reciprocating into and out of contact with said fixed contact, wherein the insulative bushing further includes a conduit portion defining the opening of the insulative bushing, wherein the conduit portion includes a first end having a first diameter and an opposite second end having a second diameter, which is larger than the first diameter, wherein the plurality of legs of the rigid retainer extend away from the opposite second end and extend away from the conduit portion of the insulative bushing, and wherein each of the plurality of legs of the rigid retainer includes a first portion extending away from the opposite second end and extending away from the conduit portion of the insulative bushing, a second portion extending away from the first portion and extending toward the first end, and a third portion extending away from the second portion and extending away from the conduit portion of the insulative bushing.

9. The vacuum interrupter of claim 8 wherein the third portion is disposed between the first end and the opposite second end; wherein the third portion of each of the plurality of legs is secured to the first end member; wherein the first end of the conduit portion extends into the first end member; and wherein the opposite second end of the conduit portion extends away from the first end member.

10. A vacuum interrupter comprising:

a number of insulative tubes including a first open end and a second open end;

a first end member secured to the first open end of said number of insulative tubes;

a second end member secured to the second open end of said number of insulative tubes;

a fixed contact mounted on a fixed electrode extending through said second end member;

a retainer comprising:

a rigid retainer including a plurality of legs and an opening, and an insulative bushing including an opening, wherein the opening of the insulative bushing is smaller than the opening of the rigid retainer, wherein the insulative bushing is molded over a portion of the rigid retainer, wherein the opening of the insulative bushing is within the opening of the rigid retainer, and wherein the opening of the insulative bushing is structured to receive a movable electrode; and a movable contact mounted on the movable electrode extending through said first end member and extending through the opening of the insulative bushing, said movable contact being capable of axially reciprocating into and out of contact with said fixed contact, wherein the first end member includes a plurality of mounting members extending away from the first end member and extending away from the first open end of the number of insulative tubes; wherein the movable electrode is disposed between the plurality of mounting members; and wherein each of the plurality of legs extends between an adjacent pair of the plurality of mounting members.

11. A retainer for a movable electrode, said retainer comprising:

a rigid retainer including a plurality of legs and an opening; and an insulative bushing including an opening, wherein the opening of the insulative bushing is smaller than the opening of the rigid retainer, wherein a portion of the rigid retainer is imbedded in the insulative bushing, wherein the insulative bushing is molded over the portion of the rigid retainer, wherein the opening of the insulative bushing is within the opening of the rigid retainer, wherein the opening of the insulative bushing receives the movable electrode, and wherein the movable electrode axially reciprocates into and out of the opening of the insulative bushing.

12. The retainer of claim 11 wherein the rigid retainer is made of metal.

13. The retainer of claim 11 wherein the rigid retainer is made of stainless steel.

14. The retainer of claim 11 wherein the insulative bushing is made of a thermoplastic resin.

15. The retainer of claim 11 wherein the insulative bushing further includes a conduit portion defining the opening of the insulative bushing.

16. The retainer of claim 15 wherein the conduit portion includes a first end having a first diameter and an opposite second end having a second diameter, which is larger than the first diameter.

17. The retainer of claim 16 wherein the plurality of legs of the rigid retainer extend away from the opposite second end and extend away from the conduit portion of the insulative bushing.

18. A retainer for a movable electrode, said retainer comprising:

a rigid retainer including a plurality of legs and an opening; and an insulative bushing including an opening, wherein the opening of the insulative bushing is smaller than the opening of the rigid retainer, wherein the insulative bushing is molded over a portion of the rigid retainer, wherein the opening of the insulative bushing is within the opening of the rigid retainer, wherein the opening of the insulative bushing is structured to receive the movable electrode, wherein the insulative bushing further includes a conduit portion defining the opening of the insulative bushing, wherein the conduit portion includes a first end having a first diameter and an opposite second end having a second diameter, which is larger than the first diameter, wherein the plurality of legs of the rigid retainer extend away from the opposite second end and extend away from the conduit portion of the insulative bushing, and wherein each of the plurality of legs of the rigid retainer includes a first portion extending away from the opposite second end and extending away from the conduit portion of the insulative bushing, a second portion extending away from the first portion and extending toward the first end, and a third portion extending away from the second portion and extending away from the conduit portion of the insulative bushing.

19. The retainer of claim 18 wherein the third portion is disposed between the first end and the opposite second end.

20. An electrical switching apparatus comprising:

a vacuum interrupter comprising:

a number of insulative tubes including a first open end and a second open end, a first end member secured to the first open end of said number of insulative tubes, a second end member secured to the second open end of said number of insulative tubes, a fixed contact mounted on a fixed electrode extending through said second end member, a retainer comprising:

a rigid retainer including a plurality of legs and an opening, and an insulative bushing including an opening, wherein the opening of the insulative bushing is smaller than the opening of the rigid retainer, wherein a portion of the rigid retainer is imbedded in the insulative bushing, wherein the insulative bushing is molded over the portion of the rigid retainer, wherein the opening of the insulative bushing is within the opening of the rigid retainer, and wherein the opening of the insulative bushing is structured to receive a movable electrode, and a movable contact mounted on the movable electrode extending through said first end member and extending through the opening of the insulative bushing, said movable contact being capable of axially reciprocating into and out of contact with said fixed contact; and an operating mechanism structured to axially reciprocate the movable electrode and move said movable contact into and out of contact with said fixed contact, wherein said number of insulative tubes, said first end member, said second end member, the fixed electrode, the insulative bushing and the movable electrode form a vacuum envelope.

21. An electrical switching apparatus comprising:

a vacuum interrupter comprising:

a number of insulative tubes including a first open end and a second open end, a first end member secured to the first open end of said number of insulative tubes, a second end member secured to the second open end of said number of insulative tubes, a fixed contact mounted on a fixed electrode extending through said second end member, a retainer comprising:

a rigid retainer including a plurality of legs and an opening, and an insulative bushing including an opening, wherein the opening of the insulative bushing is smaller than the opening of the rigid retainer, wherein the insulative bushing is molded over the rigid retainer, wherein the opening of the insulative bushing is within the opening of the rigid retainer, and wherein the opening of the insulative bushing is structured to receive a movable electrode, and a movable contact mounted on the movable electrode extending through said first end member and extending through the opening of the insulative bushing, said movable contact being capable of axially reciprocating into and out of contact with said fixed contact; and an operating mechanism structured to axially reciprocate the movable electrode and move said movable contact into and out of contact with said fixed contact, wherein the opening of the insulative bushing includes a generally circular cross-section having a number of flat surfaces; and wherein the movable electrode includes the same generally circular cross-section of the insulative bushing having the same number of flat surfaces.

22. An electrical switching apparatus comprising:

a vacuum interrupter comprising:

a number of insulative tubes including a first open end and a second open end, a first end member secured to the first open end of said number of insulative tubes, a second end member secured to the second open end of said number of insulative tubes, a fixed contact mounted on a fixed electrode extending through said second end member, a retainer comprising:

a rigid retainer including a plurality of legs and an opening, and an insulative bushing including an opening, wherein the opening of the insulative bushing is smaller than the opening of the rigid retainer, wherein the insulative bushing is molded over the rigid retainer, wherein the opening of the insulative bushing is within the opening of the rigid retainer, and wherein the opening of the insulative bushing is structured to receive a movable electrode, and a movable contact mounted on the movable electrode extending through said first end member and extending through the opening of the insulative bushing, said movable contact being capable of axially reciprocating into and out of contact with said fixed contact; and an operating mechanism structured to axially reciprocate the movable electrode and move said movable contact into and out of contact with said fixed contact, wherein the first end member includes a plurality of mounting members extending away from the first end member and extending away from the first open end of the number of insulative tubes; wherein the movable electrode is disposed between the plurality of mounting members; and wherein each of the plurality of legs extends between an adjacent pair of the plurality of mounting members.

* * * * *